US010194727B2

(12) United States Patent
Meersschaert et al.

(10) Patent No.: US 10,194,727 B2
(45) Date of Patent: Feb. 5, 2019

(54) FRAME STRUCTURE FOR A LUGGAGE ARTICLE

(71) Applicant: Samsonite IP Holdings S.a.r.l., Luxembourg (LU)

(72) Inventors: Reinhard Meersschaert, Merelbeke (BE); Dirk Santy, Koekelare (BE)

(73) Assignee: Samsonite IP Holdings S.a.r.l., Luxembourg (LU)

( * ) Notice: Subject to any disclaimer, the term of this patent is extended or adjusted under 35 U.S.C. 154(b) by 134 days.

(21) Appl. No.: 14/817,467

(22) Filed: Aug. 4, 2015

(65) Prior Publication Data

US 2016/0029763 A1 Feb. 4, 2016

(30) Foreign Application Priority Data

Aug. 4, 2014 (EP) ..... 14179714

(51) Int. Cl.

| | |
|---|---|
| ***A45C 5/14*** | (2006.01) |
| ***A45C 13/04*** | (2006.01) |
| ***A45C 5/03*** | (2006.01) |
| ***A45C 5/02*** | (2006.01) |

(52) U.S. Cl.

CPC ..... *A45C 13/04* (2013.01); *A45C 5/02* (2013.01); *A45C 5/03* (2013.01); *A45C 5/14* (2013.01); *A45C 2005/035* (2013.01)

(58) Field of Classification Search

CPC ..... A45C 5/14; A45C 13/262; A45C 5/146; A45C 13/385; A45C 3/004

USPC ..... 190/18 A, 127, 124, 122, 48

See application file for complete search history.

(56) References Cited

U.S. PATENT DOCUMENTS

| | | | | |
|---|---|---|---|---|
| 3,447,649 A * | 6/1969 | Kish, Jr. | ..... | A45C 5/00 190/111 |
| 3,881,580 A | 5/1975 | Doppelt | | |
| 3,962,010 A | 6/1976 | Riou et al. | | |
| 4,286,697 A * | 9/1981 | Baker | ..... | A45F 3/02 224/612 |

(Continued)

FOREIGN PATENT DOCUMENTS

| | | |
|---|---|---|
| CA | 2447113 A1 | 9/2003 |
| CN | 103799665 A | 5/2014 |

(Continued)

OTHER PUBLICATIONS

Extended European Search Report for application No. 14179714.2, dated Mar. 10, 2015, 5 Pages.

*Primary Examiner* — Fenn C Mathew
*Assistant Examiner* — Cynthia Collado
(74) *Attorney, Agent, or Firm* — Dorsey & Whitney LLP

(57) ABSTRACT

A luggage article may include first and second opposing panels each forming a major face panel, first and second opposing side panels each forming a minor face panel and first and second end panels. The panels together may form an article defining an enclosed space. At least one panel of the major face panels the minor face panels, or the end panels may define a groove adjacent to the periphery thereof. The luggage article may further include a first frame structure having a first frame member. The first frame member may define a ring structure positioned about the periphery of the at least one panel. The first frame member, the at least one panel, and at least one adjacent luggage panel may be joined together by a fastener positioned through the first frame member.

25 Claims, 5 Drawing Sheets

(56) References Cited

U.S. PATENT DOCUMENTS

| | | | | |
|---|---|---|---|---|
| 4,529,069 | A | 7/1985 | March | |
| 5,494,157 | A | 2/1996 | Golenz et al. | |
| 7,861,834 | B2 | 1/2011 | Gorge et al. | |
| 2004/0079604 | A1 | 4/2004 | Martin | |
| 2006/0137951 | A1* | 6/2006 | Lai | A45C 13/04 190/127 |
| 2006/0249344 | A1 | 11/2006 | Ruby et al. | |
| 2007/0045071 | A1 | 3/2007 | Gorga | |
| 2008/0078636 | A1* | 4/2008 | Lai | A45C 5/02 190/127 |
| 2009/0242344 | A1* | 10/2009 | Selvi | A45C 5/14 190/18 A |
| 2012/0247897 | A1 | 10/2012 | Sheikh | |
| 2015/0021132 | A1* | 1/2015 | Sijmons | A45C 5/03 190/120 |
| 2015/0129384 | A1* | 5/2015 | Mertens | A45C 5/14 190/127 |

FOREIGN PATENT DOCUMENTS

| | | | |
|---|---|---|---|
| EP | 2826394 | A1 | 1/2015 |
| GB | 2339679 | A | 2/2000 |
| GB | 2339679 | B | 11/2002 |

* cited by examiner

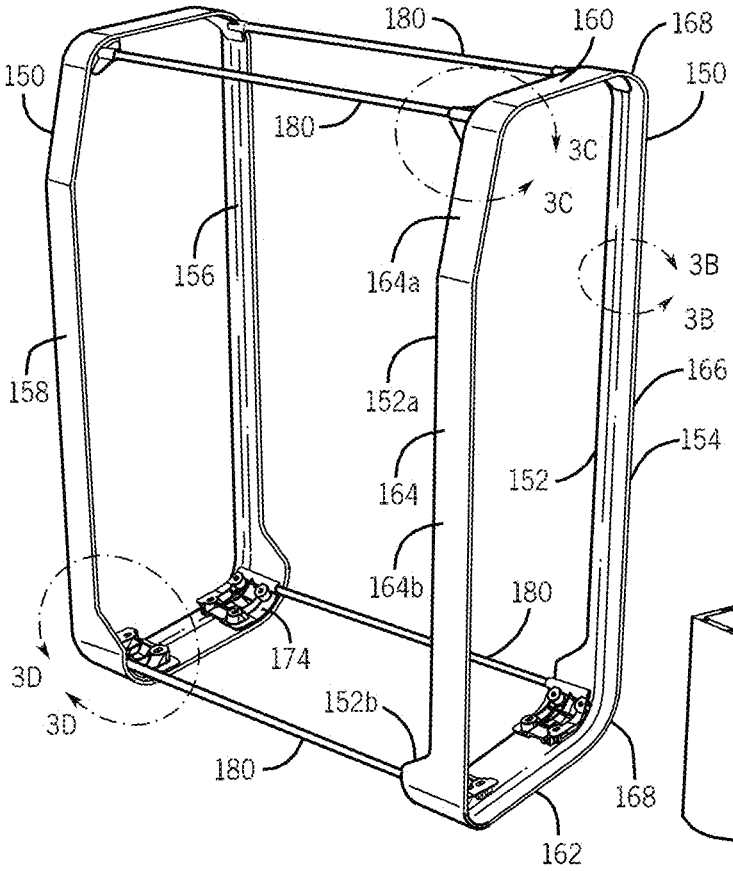
FIG. 3A
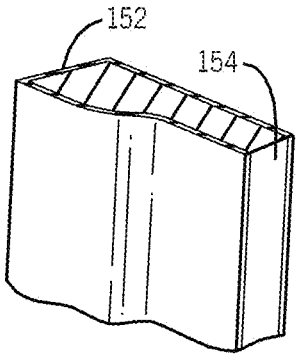
FIG. 3B
FIG. 3C
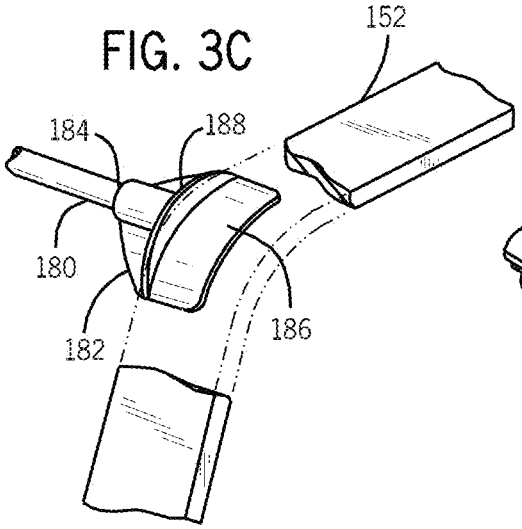
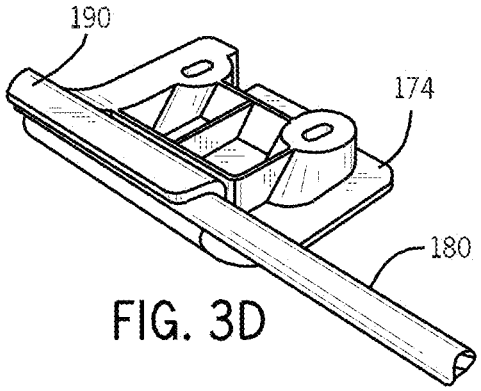
FIG. 3D

FRAME STRUCTURE FOR A LUGGAGE ARTICLE

CROSS-REFERENCE TO RELATED APPLICATION

This application claims priority to European Patent Application No. 14179714.2, filed Aug. 4, 2014, entitled "Frame Structure For a Luggage Article", which is hereby incorporated by reference herein in its entirety for all purposes.

TECHNOLOGICAL FIELD

The present disclosure generally relates to luggage. More particularly, the present disclosure relates to the structure of a luggage frame for a luggage article.

BACKGROUND

Luggage items, such as soft side suitcases, may include wire or extruded plastic reinforcement beads, honeycomb boards and/or other reinforcing panels as shape retaining structures and anchor plates for components, such as wheels and handles. A soft material, such as fabric, is wrapped around the shape retaining structure and joined thereto by sewing. Such construction of luggage articles presents a particular unique challenge. Specifically, the shape retaining structures and anchor plates have to be robust enough to form the shape of the luggage article especially under heavy loading of the luggage article. On the other hand, the shape retaining structures and anchor plates must also be light and compact so as to maximize the weight and volume that the luggage article can carry. Further, the shape retaining structures and anchor plates must also be simple to assemble and relatively cheap to produce to minimize cost.

Another challenge that has been identified with conventional soft side luggage construction is the high labor input and material cost involved because various pieces of fabric materials are first joined along the edges thereof and then turned inside out for assembly. Such construction also makes it difficult to create a straight finish.

Documents that may be related to the present disclosure in that they include various approaches to luggage construction include CA 2447113, GB2339679B, U.S. Pat. No. 3,926,010, U.S. Pat. No. 5,494,157, U.S. Pat. No. 7,861,834B2, US2004/0079604A1, US20070045071, US2006/0249344A1, and US2012/0247897A1. These proposals, however, may be improved.

It is therefore desirable to provide an improved luggage construction, in particular an improved luggage frame structure, which addresses the above described problems and/or which more generally offers improvements or an alternative to existing luggage structures and construction methods.

SUMMARY

According to the present invention there is therefore provided a luggage article as defined in the accompanying claims.

In particular described herein is a frame structure for use in luggage articles, such as soft side suitcases, hybrid suitcases, backpacks, duffels, briefcases, computer bags and so on.

In some implementations, a luggage article may include first and second adjacent panels defining two faces of the luggage article. The first panel may define a groove adjacent to the periphery thereof. The luggage article may further include a frame structure having a first frame member. The first frame member may define a ring structure positioned about the periphery of the first panel.

In some implementations, the luggage article may further include third and fourth adjacent panels. The third and fourth adjacent may oppose the first and the second adjacent panels, respectively. The luggage article may further include fifth and sixth opposing panels. The fifth and sixth panels may be adjacent to the first, the second, the third, or the fourth panels. The first, the second, the third, the fourth, the fifth, and the six panels together may form an article defining an enclosed space. The luggage article may further include a second frame structure having a second frame member. The second frame member may define a ring structure positioned about the periphery of the third panel.

In some implementations, the first and second frame members may be close together.

In some implementations, the first and second frame members may be spaced apart by at least one pultrusion.

In some implementations, the first frame member, the second frame member or both frame members may include an elongated honeycomb structure.

In some implementations, the honeycomb structure may be bent to form the ring structure.

In some implementations, the first frame member, the second frame member or both frame members may include a planar band.

In some implementations, the planar band may be perpendicular to at least one of the first panel or the third panel.

In some implementations, the first frame member, the second frame member, or both include a longitudinal portion having a variable width that increases from a center point to each end point.

In some implementations, one or more wheel assemblies may be operably joined to the portion of the frame member having increased width dimension.

In some implementations, at least one of the fifth and the sixth panels and at least one of the second and the fourth panels may be formed from at least one continuous sheet of material. The at least one continuous sheet of material may be wrapped around at least a portion of the first frame member or the second frame member.

In some implementations, the first panel may further include a rigid or semi-rigid panel member and at least one flexible, soft, or semi-soft material layer adjacent to the rigid or semi-rigid panel member. The rigid or semi-rigid panel member may define the groove adjacent to the periphery thereof. The rigid or semi-rigid panel member, the at least one flexible, soft, or semi-soft material layer, and/or the first frame member may be joined together by a common line of stitching along and partially received within the groove of the first panel.

In some implementations, the first frame member may exteriorally and/or circumferentially surround the groove of the first panel. The first frame member may be positioned between the groove of the first panel and the adjacent second panel.

In some implementations, the first frame member may be adjacent and/or parallel to the adjacent second panel. The first frame member may be joined to the adjacent second panel.

In some implementations, the groove may include two side walls. The first frame member may be aligned with at least one of the two side walls of the groove.

In some implementations, the first panel may include a minor face panel of the luggage article.

In other implementations, a luggage article may include first and second opposing panels each forming a major face panel, first and second opposing side panels each forming a minor face panel, and first and second end panels. The major face panels, the minor face panels, and the end panels together may form an article defining an enclosed space. At least one panel of the major face panels, the minor face panels, or the end panels may define a groove adjacent to the periphery thereof. The luggage article may further include a first frame structure having a first frame member. The first frame member may define a ring structure positioned about the periphery of the at least one panel.

In some implementations, the luggage article may further include a second frame structure having a second frame member. The second frame member may define a closed ring structure positioned about the periphery of another one of the major face panels, the minor face panels, or the end panels.

In some implementations, the first and second frame members may be close together.

In some implementations, the first and second frame members may be spaced apart by at least one pultrusion.

In some implementations, the first frame member, the second frame member or both frame members may include an elongated honeycomb structure.

In some implementations, the honeycomb structure may be bent to form the ring structure.

In some implementations, the first frame member, the second frame member or both frame members may include a planar band.

In some implementations, the planar band may be perpendicular to the at least one panel having the groove.

In some implementations, the first frame member, the second frame member, or both may include a longitudinal portion. The longitudinal portion may have a variable width that may increase from a center point to each end point.

In some implementations, one or more wheel assemblies may be operably joined to the portion of the frame member having increased width dimension.

In some implementations, the at least one panel may further include a rigid or semi-rigid panel member, and at least one flexible, soft, or semi-soft material layer adjacent to the rigid or semi-rigid panel member. The rigid or semi-rigid panel member may define the groove adjacent to the periphery thereof. The rigid or semi-rigid panel member, the at least one flexible, soft, or semi-soft material layer, and/or the first frame member may be joined together by a common line of stitching along the groove of the at least one side panel.

In some implementations, the common line of stitching may be partially received within the groove of the at least one panel.

In some implementations, at least one of the first and second end panels and at least one of the major face panels may be formed from at least one continuous sheet of material. The continuous sheet of material may be wrapped around at least a portion of the first frame member.

In some implementations, the first frame member may exteriorally and/or circumferentially surround the groove of the at least one panel. The first frame member may be positioned between the groove of the at least one panel and at least one other panel adjacent to the at least one panel.

In some implementations, the first frame member may be adjacent and/or parallel to the at least one other panel. The first frame member may be joined to the at least one other panel.

In some implementations, the groove may include two side walls. The first frame member may be aligned with at least one of the two side walls of the groove.

In some implementations, the at least one panel may include one of the minor face panels.

In some implementations, the closed ring structure may define a polygon. One side of the polygon and at least one of the first and second end panels may form an angle of greater than 90 degrees.

In yet another implementation, a luggage article may include first and second adjacent panels. The first and second adjacent panels may define two faces of the luggage article. The first panel may further define a groove adjacent to the periphery thereof. The luggage article may include a frame structure defining a closed ring structure. The frame structure may be positioned about the periphery of the first panel.

In further implementations, the frame structure may further define a frame width or a frame band. The frame width or band may be perpendicular to at least a portion of the first panel. The frame width or band may be parallel to at least a portion of the groove, such as at least one of the side walls forming the groove. The frame band may also be parallel to at least a portion of the second panel. The frame band may be positioned between the groove of the first panel and the adjacent second panel.

The frame structure and the panel configuration as described herein allow the various layers of materials and panels of the luggage article to be joined together to the frame structure from the exterior of the luggage article. The direct securement of surrounding components to the frame by a common stitching attachment from the exterior of the luggage article reduces the steps required to assemble the luggage article, ensures a clean finish of the shape of the luggage article, and improves the edge integrity of the luggage article.

Additionally, forming a groove along the periphery of the panel, which the frame structure surrounds, for receiving the edges of various material layers prevents the seam and the edge portions of the various materials from protruding outwardly from the exterior surface of the panel or protruding inwardly from the interior surface of the panel, thereby maximizing the volume of the luggage article.

Further, the width of the frame structure defines a lateral extension of the frame member from the panel, which the frame structure surrounds, towards the adjacent panels of the luggage article. The width or the lateral extension of the frame structure at least partially supports and shapes the adjacent panels, in addition to the panel it surrounds. Moreover, widening the honeycomb frame structure towards the bottom portion provides enhanced stability of the luggage article and allows for mounting of the wheel assemblies thereto without the need of a separate additional bottom pan.

This summary of the disclosure is given to aid understanding, and one of skill in the art will understand that each of the various aspects and features of the disclosure may advantageously be used separately in some instances, or in combination with other aspects and features of the disclosure in other instances.

BRIEF DESCRIPTION OF THE DRAWINGS

The present invention will now be described by way of example only with reference to the following figures in which:

FIG. 3A is a front perspective view of a frame structure with lateral spacing members for use with the luggage article shown in FIG. 1.

FIG. 3B is a partial cross sectional view of the portion of the frame structure encircled by line 3B-3B in FIG. 3A.

FIGS. 3C and 3D are illustrations of the connections between the lateral spacing members and the frame structure.

DETAILED DESCRIPTION

Described herein is a luggage frame structure for use in luggage articles, such as soft side suitcases, hybrid suitcases, backpacks, briefcases, computer bags, or any luggage items that contain soft portions and may desire shape and/or structural reinforcement to the soft portions.

Figure 1:
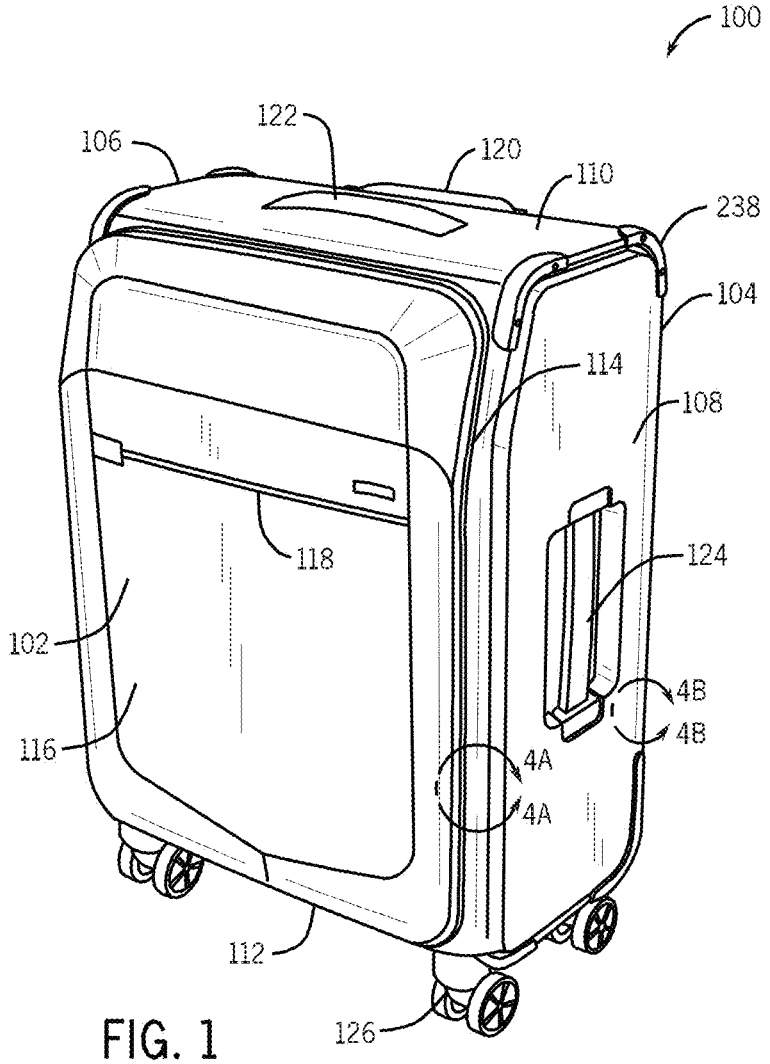
FIG. 1 is a front perspective view of a luggage article incorporating a frame structure according to one example.
Figure 2:
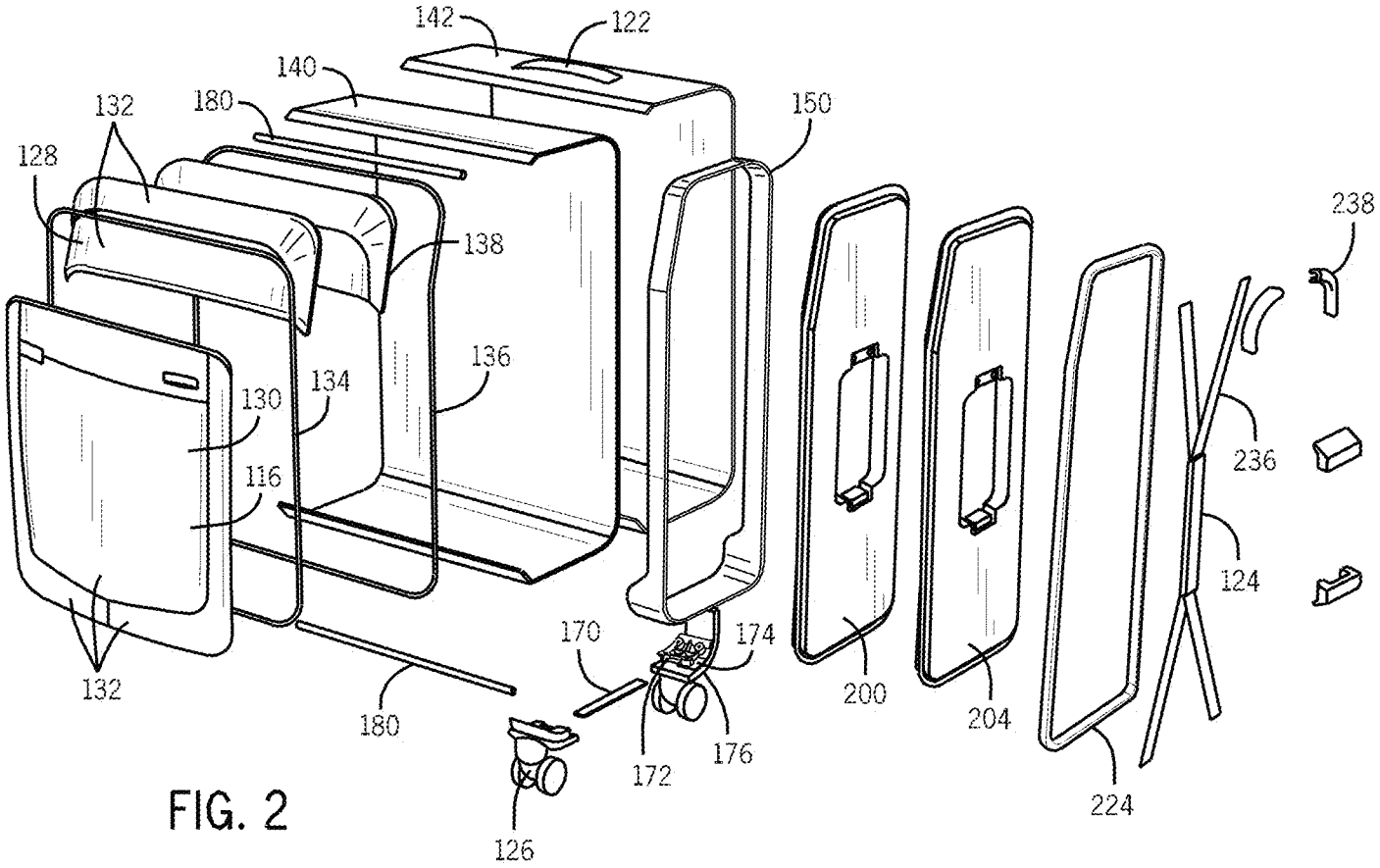
FIG. 2 is a partial exploded view of the luggage article shown in FIG. 1. Some components associated with the left side panel of the luggage article are removed.

Referring to FIGS. 1 and 2, a luggage article 100 incorporating a frame structure, according to one example, may include a generally cuboid or parallelepiped structure formed from two opposing side panels 102, 104 forming major faces of the luggage article 100, two opposing side panels 106, 108 forming minor faces of the luggage article 100, and end panels 110, 112 collectively defining a packing compartment of the luggage 100. The side panels 102, 104 forming major faces may also be referred to as the major face panels or the front and rear face panels. The side panels 106, 108 forming minor faces may also be referred to as the minor face panels or the left and right side panels. The end panels 110, 112 may also be referred to as the top and bottom panels.

Each of the panels 102, 104, 106, 108, 110, 112 may comprise an outer cover defining an outer or exterior surface of the luggage article 100. The exterior surface may be formed of relatively flexible and durable material, such as natural or man-made woven or non-woven fabrics, plastic sheets, leather, or any type of material used to form soft side luggage pieces. The front face panel 102 may be hinged to one of the left and right side panels 106, 108 and may be opened and closed by a closure mechanism 114, such as a zipper, for access to the packing compartment. The front panel 102, as well as other luggage panels 104, 106, 108, 110, 112, may include one or more pockets 116 each configured with a closure mechanism 118 for access from the outside of the luggage article 100. The luggage article 100 may include a telescoping tow handle 120 associated with the top/rear panel 110, 104 and one or more carry handles 122, 124 arranged at the top panel 110 and/or the left/right side panel 106, 108. Wheel assemblies or foot supports 126 may be joined to the bottom panel 112 of the luggage article 100.

In some implementations, one or more luggage panels 102, 104, 106, 108, 110, 112 may define a non-flat surface contour. For example without limitation and with reference to FIG. 2, the front panel 102 may include at least an upper portion 128 and a lower portion 130 oriented at an angle with respect to the upper portion 128. The one or more pockets 116 may be formed in either the upper or lower portion 128, 130 of the front panel 102, or in both portions 128, 130. The upper portion 128 and the lower portion 130 may define a left/right lateral edge profile of the front panel 102 that may be similar to the profile of a portion of an adjacent side panel frame member 150 (described in more detail below). The upper and/or lower portions 128, 130 may further include angled sub-portions 132 forming various profiles. The sub-portions 132 forming the upper and/or lower portions 128, 130 may include one or more support elements for a more defined edge profile and appearance. Such support elements may include one or more beading structures 134, 136 along the edges of the upper and/or lower portions 128, 130 and/or any of the sub-portions 132 thereof. Such support elements may further include rigid or semi-rigid panels 138, such as an EVA foam panel, supporting the outer cover of the upper and/or lower portions 128, 130 and/or any of the sub-portions 132 thereof. In some implementations, each luggage panel 102, 104, 106, 108, 110, 112 may define a substantially flat or planar surface contour. Two or more of the luggage panels 102, 104, 106, 108, 110, 112, such as the rear face panel 104 and one or both of the top and bottom end panels 110, 112, may be formed from one or more continuous sheets of material 140, 142 wrapped around to define a C-shaped structure. The one or more continuous sheets of material 140, 142 may include a backboard 140, such as a plastic board formed by polypropylene or other suitable materials, and a relatively flexible and durable exterior cover 142. The exterior cover 142 may be wrapped around a portion of the adjacent side panel frame members 150 (described in more detail below).

With reference to FIGS. 2 and 3A, the luggage article 100 may include a frame structure preferably having two frame members 150 (only one shown in FIG. 2). Each frame member 150 may be configured to support and shape the various panels 102, 104, 106, 108, 110, 112 of the luggage article 100. Each frame member 150 may be positioned along the periphery of a respective side panel, such as the left or right side panel 106, 108, of the luggage article 100, Each of the frame members 150 may define a ring structure having a shape that is defined by the desired profile or perimeter of the respective side frame member 150 or the respective side panel 106, 108. In one example, the frame member 150 may have a polygonal shape, such as shown in FIG. 3A. Each of the frame members 150 may include straight segments, curved segments, or a combination of both. The frame members 150 may or may not include well-defined corners or vertices where the segments meet depending on the application and intended design. The frame members 150 may include curved and/or smooth transitions between the segments of the frame members 150. Each frame member 150 may include a combination of defined and/or curved corners. Each of the frame members 150 may form a continuous closed loop or may include breaks along the length of extension of a frame member 150.

With reference to FIGS. 3A and 3B, each frame member 150 may include an inner longitudinal (or peripheral) edge 152 and an outer longitudinal (or peripheral) edge 154. The inner and outer longitudinal edges 152, 154 may define there-between a frame width, an inner surface 156, and an outer surface 158 of the frame member 150. The inner and outer surfaces 156, 158 may define a frame thickness there-between. The extension of the inner longitudinal edge 152 and the outer longitudinal edge 154 may define a frame profile having varying widths along the length of the frame member 150. The outer longitudinal edge 154 may extend in a relatively linear manner. The inner longitudinal edge 152 may include portions 152*a* that may extend substantially parallel to the outer longitudinal edge 154. The inner longitudinal edge 152 may further include portions 152*b* that may extend at an angle (right, acute, obtuse, and/or reverse angles) with respect to the outer longitudinal edge 154 or other portions 152*a* of the inner longitudinal edge 152. The angled portion 152*b* of the inner longitudinal edge 152 may extend in a straight line, a curved line, or a combination of these. Accordingly, the frame member 150 may include a varying width ranging from 25 to 80 mm along its longitudinal extension. The frame member 150 may include portions configured to be narrow, such as for weight reduction considerations. Other portions may be configured to be relatively wide (described in more detail below) to provide strength where needed, such as for support for attaching luggage parts, such as wheels and/or feet, handles, and for load bearing considerations.

In continuing reference to FIG. 3A, each frame member 150 may include a closed ring structure having opposing top and bottom portions 160, 162 and opposing front and rear portions 164, 166. Each of the top, bottom, front, and rear portions 160, 162, 164, 166 may include a substantially straight segment conforming to the periphery of the left/right side panels 106, 108 as well as shaping the surface contour of the major face panels 102, 104. The adjacent segments may be continuous, and may define a transition area or a corner 168 there between with a smooth, curved, arcuate, or rounded appearance. In some examples, one or more of the top, bottom, front, and rear portions 160, 162, 164, 166 may include more than one segment. For example, the front portion 164 may include an upper segment 164*a* and a lower segment 164*b* extending at an angle relative to the upper segment 164*a*. The extensions of the upper segment 164*a* and the top portion 160 of the frame member 150 (or the top end panel 110 of the luggage article 100) may define an angle of greater than 90 degrees.

Each of the frame members 150 may be formed by bending an elongated honeycomb band or strip to form a closed ring structure. Please note that the term honeycomb used herein includes, for example without limitation, a sheet structure having opposing outer layers and internal structure that defines the geometry of a honeycomb or the like. It also includes any structures that may not necessarily have the geometry of a honeycomb or the like, but may allow less amount of material to be used to reduce the weight of the structures while still maintaining the strength of the structures, for example without limitation, out-of-plane compression or shear properties of the structures, at a desired level.

To form the frame member 150, the two ends of the honeycomb band may be joined together by fasteners, sewing, gluing, welding, bonding, adhering, stapling, or any suitable connection method. The joint may be positioned at the top portion 160 of the frame member 150 near a center thereof such that the frame member 150 is symmetrical about a vertical plane through the connection joint. Forming the joint at the top portion 160 of the frame member 150 may ensure that the bottom portion 162 where the wheel assemblies and/or feet 126 are joined to is continuous, thus having better strength and load bearing properties. The joint may be formed at the front, rear, or even bottom portion 164, 166, 162 of the frame member 150. When the joint is formed at the bottom portion 162 of the frame member 150, the bottom portion 162 may be reinforced with a reinforcing strip of material 170, such as a strip of fiber glass material, extending along the bottom portion 162 of the frame member 150 (see FIG. 2). Each of the ends of the reinforcing strip 170 may be received in a recess 172 formed in an inner connecting piece 174 of an adjacent wheel assembly 126 (described in more detail below). When the wheel assembly 126 is joined to the frame member 150, the reinforcing strip of material 170 may be held against the inner/upper surface 156 of the bottom portion 162 of the frame member 150.

The hollow cells of the honeycomb structure may be oriented parallel to the longitudinal dimension of the honeycomb strip for forming the frame members 150. Accordingly, with respect to the formed frame member 150, the hollow cells may extend along the longitudinal dimension of each segment from one corner 168 to another corner 168 of the frame member 150. Such corner-to-corner extension of the hollow cells may provide better strength for the frame member 150 along the longitudinal dimension thereof, which may in turn help maintain the shape of the frame member 150 upon impact. The hollow cells of the honeycomb structure may be oriented perpendicular to, or at any appropriate angle with respect to, the longitudinal dimension of the honeycomb strip for forming the frame members 150.

With continued reference to FIGS. 2 and 3A, the bottom segment or portion 162 of each frame member 150 and/or the transition areas 168 from the bottom segment 162 to the front and rear segments 164, 166 may include a greater frame width of between approximately 60 and 80 mm along the longitudinal dimension of the frame member 150 compared to other segments or portions, such as the front/rear/top portions, 164, 166, 160 of the frame member 150 with a smaller frame width of between approximately 25 and 35 mm. The increased frame width may provide an anchor area for joining wheel assemblies or support feet 126 to the bottom of the luggage article 100, and also provide a load-bearing structure for the item in the luggage article 100. Conventionally, a rigid base board of a size substantially similar to that of the bottom end panel 112 of the luggage article 100 is required to provide sufficient structural strength for mounting the wheel assemblies 126 thereto as well as for supporting the load. With the frame structure as described herein, such base board may be optional or omitted. Accordingly, a luggage article 100 incorporating the frame structure as described herein may weigh less compared to conventionally constructed luggage cases.

Although FIGS. 2 and 3A show that the bottom portion 162 of each frame member 150 may include a consistent frame width along the longitudinal dimension thereof, the bottom portion 162 may have a variable width. The bottom portion 162 may include a narrower middle portion and two wider end portions where the wheel assemblies 126 may be joined to. As such, the width of the bottom portion 162 may increase from a center point thereof towards each end point or corner 168 gradually or in a stepped manner.

With reference to FIG. 2, each of the wheel assemblies 126 may include an inner connecting piece 174 and an outer connecting piece 176. The outer connecting piece 176 may include a wheel housing and/or a wheel support for operably joining a wheel to a corner portion of the luggage article 100. The inner connecting piece 174 and the outer connecting piece 176 may sandwich there between a portion of the frame member 150, such as end portions of the bottom portion 162 and the transition area or the corner 168 between the bottom portion 162 and the front/rear portion 164, 166 of the frame member 150. The inner and outer connecting pieces 174, 176 may be operably joined to the frame member 150 by one or more fasteners, screws, rivets, adhesive, welding, and so forth.

With further reference to FIG. 3A, to maintain the proper spacing between the two frame members 150, elongated lateral spacing members 180, such as one or more pultrusions, may be positioned between the frame members 150 and operably secured thereto by fasteners, gluing, welding, stapling, or any other suitable connection mechanism and so forth. The pultrusions 180 may be formed by extrusion and cut into any appropriate desired length to allow for different spacing between the frame members 150, thereby allowing simplicity in the assembly of luggage articles 100 with various width dimensions. The luggage article 100 may include four lateral spacing members 180 each positioned between two corresponding corner regions 168 of the frame members 150. For a luggage article 100 of relatively small size, only two lateral spacing members 180 near the front panel 102 may be needed (see FIG. 2).

With reference to FIG. 3C, a mechanical connector 182 for joining the lateral spacing members 180 to the frame members 150 may include a recess 184 for receiving an end portion of the lateral spacing member 180, a flange portion 186 extending from an end of the recess 184 for joining to the frame member 150, and an abutment ridge 188 positioned between the recess 184 and the flange portion 186. The outer side of the ridge 188 may be positioned against the inner longitudinal edge 152 of the frame member 150 when joined thereto. The end portion of the lateral spacing member 180 is held in place within the recess 184 by friction, and in some examples, additional adhesive or other mechanical fasteners may be used. The flange portion 186 of the connector may be curved to match the curved shape of the frame member 150 to which it is attached. For instance as shown in FIG. 3A, the flange 186 engages the frame member 150 at a curved portion between the front and top panels 102, 110. The flange portion 186 of the connector 182 may be attached to any other suitable portion of the frame member 150.

With reference to FIG. 3D, the inner connecting piece 174 for joining the wheel assembly 126 to the frame member 150 and to the bottom of the luggage article 100 may also join the lateral spacing members 180 to the frame members 150. The inner connecting piece 174 may include an arch portion 190 across its length/width dimension. The arch portion 190 may define a concave surface that conforms to and receives the end portion of the lateral spacing member 180 and holds the lateral spacing member 180 in place. The inner connecting piece 174 may further include a side wall portion closing the distal end of the arch portion 190. The lateral spacing member 180 may be held in place by compression between the concave surface of the inner connecting piece 174 and the inner surface 156 of the frame member 150 to which the inner connecting piece 174 is attached. Additional adhesive or other mechanical fasteners may be used.

The elongated lateral spacing elements 180 add structural strength to the luggage article 100 and support the shape thereof. The elongated lateral spacing members 180 provided near the rear portion 166 of the frame member 150 divert the force and impact from the backboard 140 and/or the wheel assemblies 126 when the luggage article 100 is dropped on the edges or the corners. As such, the backboard 140 may be made thinner, which further reduces the weight of the luggage article 100. The elongated lateral spacing members 180 create a clean straight appearance for the edge portions of the luggage article 100 formed around the spacing member 180. Moreover, the first and third elongated lateral spacing members 180, together with the top portions 160 of the frame members 150, form a square frame. This square frame adds strength to the top end panel 110 and keeps the top end panel 110 flat when the luggage article 100 is carried by the top carry handle 122.

Figure 4A:
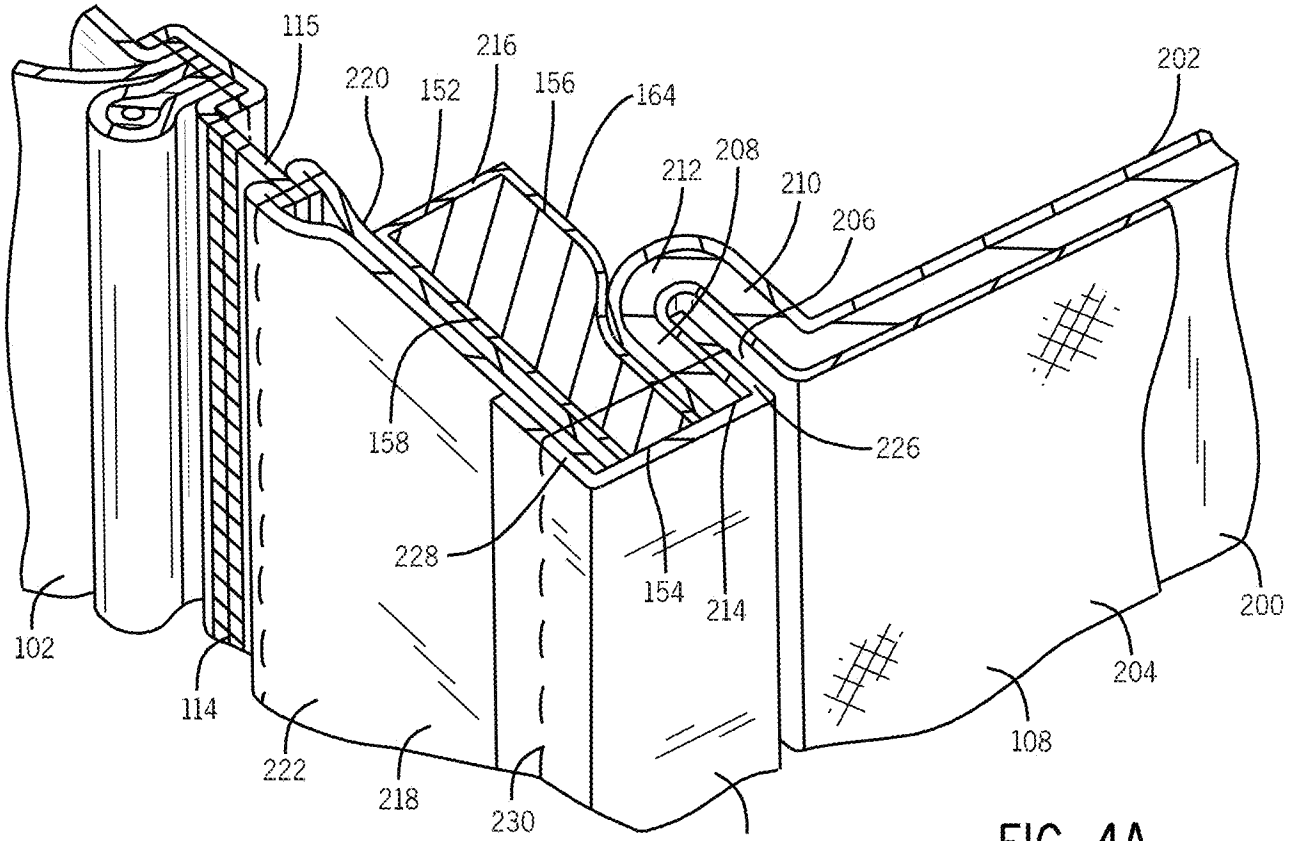
FIG. 4A is a partial cross sectional view of the portion of the luggage article encircled by line 4A-4A in FIG. 1.

Each honeycomb frame member 150 may operably support and join a side panel 106, 108 to the adjacent front, rear, top, and bottom luggage panels 102, 104, 110, 112. With reference to FIG. 4A, the front portion 164 of the frame member 150 connects the adjacent front major face and right side luggage panels 102, 108. The right side panel 108 may include a semi-rigid panel member 200, an inner lining 202, and an outer cover 204. The inner lining 202 and the outer cover 204 may each be made of a relatively soft or flexible material, such as textile, fabric, leather, plastic, or any other suitable material, whether man-made or natural. The inner lining 202 and the outer cover 204 may define the interior and exterior surfaces of the side panel 108, respectively. The semi-rigid panel member 200 may include a plastic panel formed of ethylene vinyl acetate (EVA) foam or any other suitable polymeric or rubber material.

With further reference to FIG. 4A, the semi-rigid panel member 200 may define a groove 206 adjacent to the periphery thereof along the entire periphery, or portions thereof, of the semi-rigid panel member 200. The groove 206 may define a U-shaped recess open toward the exterior of the luggage article 100, and include substantially straight first and second legs or sidewalls 208, 210 and one curved bottom 212 joining the two legs 208, 210. The first leg 208 includes a free end 214 that defines the peripheral edge of the semi-rigid panel member 200. The frame member 150 exteriorally or circumferentially surrounds the groove 206 and the right side panel 108 such that the inner surface 156 of the frame member 150 and the first leg 208 of the U-shaped groove 206 may be positioned in an abutting relationship. Accordingly, the frame member 150 may be substantially perpendicular to the adjacent side panel (right side panel 108 as shown in FIG. 4A) surrounded by the frame member 150 and/or substantially parallel to the depth of the U-shaped groove 206. The outer longitudinal edge 154 of the frame member 150 and the free end 214 of the U-shaped groove 206 (or the edge of the semi-rigid panel member 200) may be flush or align with each other, and preferably be flush or align with the central planar portion of the semi-rigid panel member 200.

In continuing reference to FIG. 4A, an edge portion of the flexible outer cover 204 of the side panel 108 may be received within the groove 206 of the semi-rigid panel member 200 adjacent to the first leg 208 of the U-shaped groove 206. An edge portion of the flexible inner lining 202 for the semi-rigid panel member 200 may be positioned between the first leg 208 of the U-shaped groove 206 and the adjacent inner surface portion 156 of the frame member 150. In some implementations, the frame member 150 may include a lining material 216 wrapped around the inner surface 156, the inner longitudinal edge 152, and the outer surface 158 of the frame member 150. The edge portion of the lining material 216 covering the inner surface 156 of the frame member 150 may also be positioned between the inner surface 156 of the frame member 150 and the side wall 208 of the U-shaped groove 206 having the free end 214.

An intermediate extension trim material 218 may be positioned adjacent to the outer surface 158 of the frame member 150 in an overlapping configuration and joined thereto. The trim material 218 may be used to accommodate the width dimension of the frame member 150 and to join the zipper 114 associated with the front panel 102 to the frame member 150. The trim material 218 may include an inner lining 220 and an outer cover 222 similar to the inner lining 202 and the outer cover 204 of the side panel 108 described above. The edge portions of the inner lining 220 and outer cover 222 of the trim material 218 may be aligned with and/or overlap the outer longitudinal edge 154 portion of the frame member 150. In some implementations, such trim material 218 may be not needed, and the zipper tape 115 of the zipper 114 may be positioned adjacent to the outer surface 158 of the frame member 150 in an overlapping configuration and joined directly thereto.

Referring still to FIG. 4A, the sandwich layers formed, in this example, by the edge portions of the lining 202, the semi-rigid panel member 200, and the outer cover 204 for the luggage side panel 108, the outer longitudinal edge 154 portion of the frame member 150, the lining material 216 for the frame member 150, and the lining 220 and the outer cover 222 for the trim material 218 (or the zipper tape 115 in some implementations), may all align with and/or overlap each other and extend sufficiently towards the outer edge 154 of the frame 150, such as in one example, to be substantially flush with the outer surface of the side panel 108. A U-shaped binding member 224 is positioned over the free end of the sandwich structure. One leg 226 of the U-shaped binding 224 is received in the groove 206, and the other leg 228 of the U-shaped binding 224 is positioned over the trim material 218. The various edge portions received in the U-shaped binding 224 and the surrounding two legs 226, 228 of the U-shaped binding 224 are joined together by a fastener, such as one or more lines of stitching 230, from the outside of the luggage article 100. The fastener 230 is applied through the sandwich layer structure from the outside leg 228 of the binding 224 through to the other leg 226 of the binding 224 positioned in the groove 206. Accordingly, the fastener 230 is at least partially received within the groove 206. Alternatively, the binding 224 and the various edge portions received within the binding 224 may be joined together by stapling, gluing, welding, or any suitable connection mechanism. The binding 224 may include a material similar to the outer cover 204 of the side panel 108, such as fabric, textile, woven, man-made, natural, or any suitable material. When assembled, the binding 224 and the side panel 108 may be substantially flush with each other. In some implementations, the binding 224 may be optional and may be omitted. The outer cover 222, 204 of the trim material 218 or the side panel 108 may wrap around the free end of the sandwich structure. However, a separate outside binding 224 may provide several benefits. The binding material 224 may be made from a strong and tough material to protect the edges of the luggage article 100 from wear. The outside binding 224 also creates a unique appearance of the luggage article 100 because the outside binding 224 shows strength and gives the luggage article 100 a sturdy look.

One aspect of configuring the side panel 106, 108 with a semi-rigid panel member 200 formed with a peripheral groove 206 is to facilitate the assembly of the luggage article 100. The groove 206 of the semi-rigid panel member 200 may be configured with appropriate width and depth such that the sewing foot for sewing/stitching together the sandwich structure and the binding 224 may be positioned within the groove 206, thereby sewing the various layers together from the outside of the luggage 100. Conventionally, various pieces of panel materials are first joined together and then turned inside out to form the luggage. A problem with this approach is that it is difficult to maintain a straight finished product. The grooves 206 formed along the peripheries of the left and right side panels 106, 108 allow for direct securement of surrounding components to the frame 150 by a common stitching attachment 230 from the outside of the luggage article 100, which reduces the steps required to assemble the luggage article 100, ensures a clean finish of the shape of the luggage article 100, and improves the edge integrity of the luggage article 100.

Further in contrast with conventional luggage construction, the grooves 206 formed along the peripheries of the side panels 106, 108 receive the seam 230 and edges portions of various material layers. Such configurations prevent the seam 230 and the edge portions of the various materials from protruding outwardly from the side panel 106, 108 further than the exterior surface of the left/right side panels 106, 108 or protruding inwardly from the side panel 106, 108 further than the interior surface of the left/right side panels 106, 108. The luggage article 100 configuration as described herein maximizes the volume of the luggage article 100.

Referring back to FIGS. 3B and 4A, to further facilitate the sewing operation, the frame member 150 may include a reduced thickness dimension near the outer longitudinal edge 154 so as to reduce the thickness of the binding 224 for receiving therein the edge portions of the various layers of the materials. The reduced thickness may be created by localized thinning of the honeycomb material forming the frame member 150. The localized thinning may be accomplished by compressing the material of the frame in a manner that reduces the thickness in a lasting manner. Alternatively, the localized thinning may be manufactured into the frame material dimensions. The localized thinning may be utilized around the entire perimeter of the frame member 150 or it may be utilized only in selected locations. In one example, the localized thinning may be approximately 0.5 to 2 centimeters wide measured from the outer longitudinal edge 154 of the frame member 150 toward the inner longitudinal edge 152. The thickness of the frame member 150 near the outer longitudinal edge 154 may be reduced by 1.5 mm or less to maintain desirable structural strength. Where increased strength is desired, it may be determined that not having a localized thinning feature is preferred.

Another advantage of using the frame structures 150 formed from honeycomb band is that it eliminates the need of fitting wire beads to the exterior of at least the left and right side panels 106, 108. It may even eliminate any wire beads. Accordingly, the frame structures 150 and panel configurations as described herein make it possible to form a luggage article 100 with minimal protrusions at the corners, thereby enhancing the structural integrity of the luggage article 100 and reducing the chances of fraying or breakage. Moreover, the side frame structures 150, together with the lateral spacing members 180, provides structural support for the luggage article 100 in all three dimensions along the height (vertical), width (horizontal), and depth (horizontal) dimensions of the luggage article 100.

Additionally, the width of the frame members 150 defines a lateral extension of the frame member 150 from the left/right side panels 106, 108 towards a center of the luggage article 100 along the top/bottom end panels 110, 112 and the front and rear face panels 102, 104. The frame members 150 each may be positioned between the groove 206 of the left/right side panels 106, 108 and the adjacent front/rear and top/bottom panels 102, 104, 110, 112. The frame member 150, or the lateral extension thereof, may be substantially parallel to the front/rear and top/bottom panels 102, 104, 110, 112. The frame member 150 may be also aligned with and/or parallel to the adjacent side wall 208 of the groove 206. Therefore, the width or the lateral extension of the side frame members 150 at least partially support and shape the other adjacent panels 102, 104, 110, 112, in addition to supporting the left/right side panels 106, 108, of the luggage article 100. Additionally, the honeycomb frame structure 150 being wider towards the bottom portion 162 provides enhanced stability of the luggage article 100 and allows for mounting of the wheel assemblies 126 thereto without the need of a separate additional bottom pan.

Figure 4B:
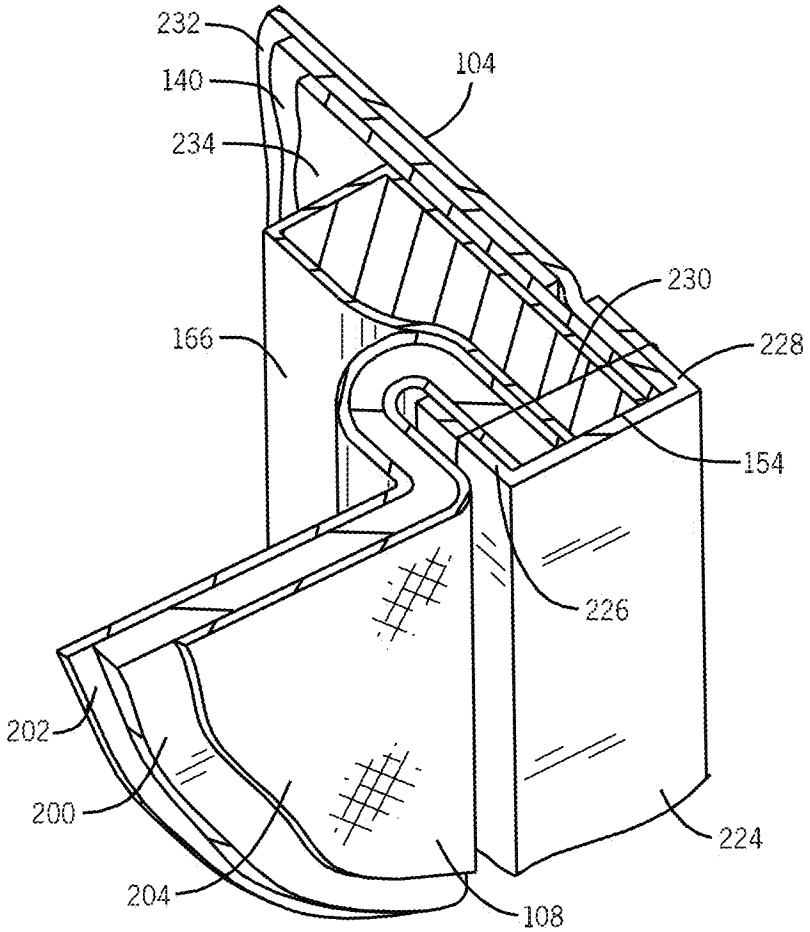
FIG. 4B is a partial cross sectional view of the portion of the luggage article encircled by line 4B-4B in FIG. 1.

With reference to FIG. 4B, the rear luggage panel 104 and the side panel 108 may be joined to the rear portion 166 of the frame member 150 in a manner similar to that described above with reference to FIG. 4A. The rear panel 104 may include an outer cover 232 and an inner lining 234 similar to those of the side panel 108. A sandwich structure may be formed by the overlapping edge portions of the inner lining 202, semi-rigid panel member 200, and the outer cover 204 of the side panel 108, the outer longitudinal edge 154 of the frame member 150, edge portions of the outer cover 232 and the inner lining 234 of the rear panel 104. As described above with respect to FIG. 4A, the free end of the sandwich structure may generally align with and be flush with the outer surface of the side panel 108. A U-shaped binding 224 may be positioned over the free end of the sandwich structure, which may then be joined to the legs 226, 228 of the binding 224 by a fastener 230, such as one or more lines of stitching, or by stapling, gluing, welding, or any other suitable connection mechanism, from the outside of the luggage article 100. The U-shaped binding 224 of FIG. 4B and the U-shaped binding 224 of FIG. 4A may be one continuous piece of binding material surrounding the entire peripheries of the side panel 108, the frame member 150, and the panels 102, 104, 110, 112 adjacent to the side panel 108. In some implementations, multiple segments of binding materials may be used.

After the various layers of the rear panel 104 and the side panel 108 are joined to the frame member 150, the backboard 140 (see FIG. 2) may be inserted between the outer cover 232 and the inner lining 234 of the rear panel 104. In some implementations, the outer cover 232, the backboard 140, and the inner lining 234 may extend toward the front of the luggage article 100 at its upper and lower edges to define a C shape and to form the top and bottom end panels 110, 112 integrally.

It should be noted that additional layers of materials, such as the flange portion 186 of the connector 182 for attaching the spacing members 180, ends of the elastic webbing 236 for securing the carrying handle 124 (see FIG. 2) and any other suitable layers of materials, may be positioned adjacent to the inner and/or outer surfaces 156, 158 of the frame member 150 along any suitable portion thereof, such as corner regions 168 of the frame member 150. Such additional layers of materials may be alternatively positioned inside the groove 206 of the left/right side panels 106, 108 and joined thereto. The edge portions of these additional layers of materials, together with the edge portions of other layers of materials as described above, may form a sandwich structure described above with reference to FIGS. 4A and 4B. The free end of the sandwich structure be received within a binding 224 and joined together by one or more common lines of stitching 230. To avoid abrasion, fraying, or breakage of the binding material 224, the luggage article 100 may be configured with corner protections 238 (see FIGS. 1 and 2) outside the binding 224, such as plastic corner protectors 238 joined to the top corners of the luggage article 100 by fasteners, sewing, gluing, welding, bonding, adhering, stapling, or any suitable connection method. In some examples, the corner protectors 238 may also be joined to the sandwich structure by the one or more common lines of stitching 230.

Although a frame structure having two frame members 150 is described herein as side frame structures surrounding the left and right side panels 106, 108 of the luggage article 100, it should be noted that the luggage article 100 may use less or more frame members 150. Each frame member 150 may be utilized to surround any panel 102, 104, 106, 108, 110, 112 of a luggage article 100 that may be formed with a groove 206 adjacent to the periphery thereof. The frame member 150, the panel surrounded by the frame member 150, and an adjacent panel may be joined together in a manner similar to the attachment between the front and rear face panels 102, 104 and the right side panel 108 as described above with reference to FIGS. 4A and 4B.

Although a soft side luggage case is described herein as examples, the various frame structures as described herein may be incorporated to hybrid suitcases, backpacks, briefcases, computer bags, or any luggage items that contain a soft portion and may desire shape and/or structure reinforcement.

It should be noted that all directional and/or dimensional references (e.g., upper, lower, upward, downward, left, right, leftward, rightward, top, bottom, above, below, front, back, rear, forward, backward, rearward, inner, outer, inward, outward, vertical, horizontal, clockwise, counterclockwise, length, width, height, depth, and relative orientation) are only used for identification purposes to aid the reader's understanding of the implementations of the disclosed invention(s), and do not create limitations, particularly as to the position, orientation, use relative size or geometry of the invention(s) unless specifically set forth in the claims.

Connection references (e.g., attached, coupled, connected, joined, and the like) are to be construed broadly and may include intermediate members between a connection of elements and relative movement between elements. As such, connection references do not necessarily infer that two elements are directly connected and in a fixed relation to each other.

In some instances, components are described with reference to "ends" having a particular characteristic and/or being connected with another part. However, those skilled in the art will recognize that the disclosed invention(s) is not limited to components that terminate immediately beyond their points of connection with other parts. Thus, the term "end" should be interpreted broadly, in a manner that includes areas adjacent, rearward, forward of, or otherwise near the terminus of a particular element, link, component, part, member or the like. In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made that are within the scope of the appended claims.

The invention claimed is:

1. A luggage article, comprising:

first and second adjacent panels defining two faces of the luggage article;

third and fourth adjacent panels opposing the first and the second adjacent panels, respectively;

fifth and sixth opposing panels adjacent to the first, the second, the third, or the fourth panels; and the first, the second, the third, the fourth, the fifth, and the six panels together forming an article defining an enclosed space;

wherein:

the first panel is a side panel and includes a central panel portion;

the first panel defines a groove adjacent to a periphery thereof, wherein the groove is defined by a bottom wall and two parallel side walls and the groove opens outwards from the luggage article;

the groove is positioned between adjacent the periphery of the first panel and the central panel portion; and a frame structure having a first frame member defining a ring structure is positioned about the periphery of the first panel.

2. A luggage article of claim 1, further comprising:

a second frame structure having a second frame member defining a ring structure positioned about a periphery of the third panel.

3. A luggage article of claim 2, wherein the first and second frame members are close together or are spaced apart by at least one pultrusion.

4. A luggage article of claim 2, wherein the first frame member, the second frame member or both frame members include an elongated honeycomb structure.

5. A luggage article of claim 4, wherein the honeycomb structure is bent to form the ring structure.

6. A luggage article of claim 2, wherein the first frame member, the second frame member or both frame members include a planar band.

7. A luggage article of claim 6, wherein the planar band is perpendicular to at least one of the first panel or the third panel.

8. A luggage article of claim 2, wherein the first frame member, the second frame member, or both include a longitudinal portion having a variable width that increases from a center point to each end point of the longitudinal portion.

9. A luggage article of claim 8, wherein one or more wheel assemblies are operably joined to the portion of the frame member having increased width dimension.

10. A luggage article of claim 1, wherein:

at least one of the fifth and the sixth panels and at least one of the second and the fourth panels are formed from at least one continuous sheet of material wrapped around at least a portion of the first frame member or the second frame member.

11. A luggage article of claim 1, wherein the first panel further comprises:

a rigid or semi-rigid panel member, the rigid or semi-rigid panel member defining the groove adjacent to the periphery of the first panel;

at least one flexible, soft, or semi-soft material layer adjacent to the rigid or semi-rigid panel member; and the rigid or semi-rigid panel member, the at least one flexible, soft, or semi-soft material layer, and/or the first frame member are joined together by a common line of stitching along and partially received within the groove of the first panel.

12. A luggage article of claim 1, wherein:

the first frame member exteriorally and/or circumferentially surrounds the groove of the first panel; and the first frame member is positioned between the groove of the first panel and the adjacent second panel.

13. A luggage article of claim 12, wherein:

the first frame member is adjacent and/or parallel to the adjacent second panel; and the first frame member is joined to the adjacent second panel.

14. A luggage article of claim 1, wherein:

the first frame member is aligned with at least one of the two parallel side walls of the groove.

15. The luggage article of claim 1, wherein the central panel portion extends between the groove defined on opposing sides of the first panel.

16. The luggage article of claim 1, wherein the groove is positioned internal relative to the first frame member.

17. The luggage article of claim 1, wherein the central panel portion of the first panel is in line with the periphery of the first panel.

18. A luggage article, comprising:

first and second adjacent panels defining two faces of the luggage article;

third and fourth adjacent panels opposing the first and the second adjacent panels, respectively;

fifth and sixth opposing panels adjacent to the first, the second, the third, or the fourth panels; and the first, the second, the third, the fourth, the fifth, and the six panels together forming an article defining an enclosed space;

wherein:

the first panel is a side panel and defines a groove adjacent to a periphery thereof;

the first panel comprises a rigid or semi-rigid panel member, the rigid or semi-rigid panel member defining the groove adjacent to the periphery of the first panel;

at least one flexible, soft, or semi-soft material layer is adjacent to the rigid or semi-rigid panel member;

a frame structure having a first frame member defines a ring structure positioned about the periphery of the first panel; and the rigid or semi-rigid panel member, the at least one flexible, soft, or semi-soft material layer, and/or the first frame member are joined together by a common line of stitching along and partially received within the groove of the first panel.

19. A luggage article of claim 18, further comprising:

a second frame structure having a second frame member defining a ring structure positioned about a periphery of the third panel.

20. A luggage article of claim 19, wherein the first and second frame members are close together or are spaced apart by at least one pultrusion.

21. A luggage article of claim 19, wherein the first frame member, the second frame member or both frame members include an elongated honeycomb structure.

22. A luggage article of claim 21, wherein the honeycomb structure is bent to form the ring structure.

23. A luggage article of claim 19, wherein the first frame member, the second frame member, or both include a longitudinal portion having a variable width that increases from a center point to each end point of the longitudinal portion.

24. A luggage article of claim 23, wherein one or more wheel assemblies are operably joined to the portion of the frame member having increased width dimension.

25. A luggage article of claim 18, wherein:

the first frame member exteriorally and/or circumferentially surrounds the groove of the first panel; and the first frame member is positioned between the groove of the first panel and the adjacent second panel.

* * * * *